US005142261A

United States Patent [19]

Fuller et al.

[11] Patent Number: 5,142,261

[45] Date of Patent: Aug. 25, 1992

[54] CONSTANT-ON, VARIABLE-STROKE REFRIGERATION THERMOSTAT

[75] Inventors: Kennett R. Fuller; Ronald W. Kelly, both of Morrison, Ill.

[73] Assignee: General Electric Company, Fort Wayne, Ind.

[21] Appl. No.: 748,468

[22] Filed: Aug. 22, 1991

[51] Int. Cl.[5] ..... H01H 61/00; H01H 87/00; H01H 37/12

[52] U.S. Cl. ..... 337/115; 337/323

[58] Field of Search ..... 337/306-323, 337/114-119

[56] References Cited

U.S. PATENT DOCUMENTS

| | | | |
|---|---|---|---|
| 2,216,589 | 10/1940 | Grooms . | |
| 2,611,845 | 9/1952 | Miller . | |
| 2,627,561 | 2/1953 | Grimshaw . | |
| 2,651,692 | 9/1953 | Slonneger . | |
| 2,658,121 | 11/1953 | Gray et al. . | |
| 2,711,079 | 6/1955 | Grimshaw . | |
| 2,738,397 | 3/1956 | Slonneger . | |
| 2,762,888 | 9/1956 | Jacobs . | |
| 2,795,674 | 6/1957 | Grimshaw . | |
| 2,885,513 | 5/1959 | Judd . | |
| 2,889,432 | 6/1959 | Miller . | |
| 3,065,320 | 11/1962 | Cobean . | |
| 3,065,323 | 11/1962 | Grimshaw . | |
| 3,096,419 | 7/1963 | Howell . | |
| 3,177,321 | 4/1965 | Grimshaw . | |
| 3,648,012 | 3/1972 | Holtkamp | 219/413 |
| 3,648,214 | 3/1972 | Slonneger | 337/311 |
| 3,891,957 | 6/1975 | Holtkamp | 337/347 |
| 3,967,086 | 6/1976 | Bauer . | |
| 4,144,515 | 3/1979 | Bergman | 337/319 |
| 4,274,546 | 6/1981 | Branson et al. . | |
| 4,490,708 | 12/1984 | Thompson et al. | 337/320 |
| 4,547,760 | 10/1985 | Rejc | 337/323 |
| 4,617,803 | 10/1986 | Rossi . | |
| 4,937,549 | 6/1990 | Kelly et al. | 337/309 |

OTHER PUBLICATIONS

Ranco Information Bulletin No. 1531010, "K" *Series Temperature Control*, 4 pages, 1981.

Ranco Brochure *K54, Cycling Control With Signal Switch*, 2 pp.

Ranco Brochure *K50, Fixed or Adjustable Cycling Thermostat, 2 pp.*

Ranco Catalog Sheets, *Temperature Controls Series 'K'*, pp. 1-17, 1989.

General Electric Catalog Sheets, *Appliance Control Department Cold Controls*, No. GEA-10879 (5M), 16 pp., 1980.

*Primary Examiner*—Harold Broome

*Attorney, Agent, or Firm*—Ralph E. Krisher, Jr.

[57] ABSTRACT

A constant-on variable-stroke refrigeration thermostat is disclosed wherein the toggle spring-biased operating lever has a fixed-position stop when the contacts are open and a variable-position stop when the contacts are closed, and wherein an air gap is provided between the actuator prong of the operating lever and the moveable contact blade of the switch contacts to allow the operating lever to travel downwardly with increased momentum before the switch contacts are opened. The primary advantage provided by the present invention is that the thermostat is of a much simpler construction, which results in a lower cost and a higher reliability.

16 Claims, 5 Drawing Sheets

CONSTANT-ON, VARIABLE-STROKE REFRIGERATION THERMOSTAT

FIELD OF THE INVENTION

The present invention generally relates to a condition-responsive switching apparatus, preferably used as a temperature-sensing control in a refrigeration unit. More particularly, the present invention is an improved off-cycle defrost refrigeration thermostat of the constant-on, variable-differential variety.

BACKGROUND OF THE INVENTION

Switches that are responsive to temperature changes, commonly known as thermostats or cold controls, are used in refrigeration appliances, such as refrigerators and freezers, to control the temperatures therein. These thermostats regulate the switching cycle of the refrigeration compressor in response to the temperature of the air contained at some location within the appliance. When the temperature exceeds a certain "turn-on" point, the switch contacts are closed and the compressor is switched on to cool the appliance. When the temperature drops below a certain "turn-off" point, the switch contacts are opened and the compressor is switched off. The temperature then begins to rise, and the refrigeration cycle begins again. Examples of thermostats for refrigeration appliances are set forth in U.S. Pat. No. 2,795,674 issued to Grimshaw, U.S. Pat. No. 3,096,419 issued to Howell, and U.S. Pat. No. 4,937,549 issued to Kelly et al. All of these patents are assigned to the General Electric Company, the assignee of the present invention, and their disclosure is expressly incorporated herein by reference.

One specific type of refrigeration thermostat is often referred to as a "constant-on" thermostat. This type of switch is constructed to turn the compressor on at a constant, preset turn-on temperature. However, the compressor turn-off temperature is selectively adjustable by the user. Such constant-on thermostats are often used in "off-cycle defrost" refrigeration units, wherein the defrosting of the evaporating unit is initiated after each cooling cycle. The constant turn-on temperature is usually preset within the thermostat to be several degrees above freezing, for example, 36° F. In this way, the frost which accumulates during each cooling cycle will melt away when the temperature of the evaporating unit is permitted to rise up to the compressor turn-on temperature. In such an off-cycle defrost refrigeration unit, it is necessary to prevent the user from manually adjusting the compressor turn-on temperature, since huge amounts of frost would build up on the evaporator if the user were to adjust the compressor turn-on temperature to be below 32° F.

Accordingly, when the user adjusts the temperature control knob of a refrigeration appliance having a constant-on thermostat, only the compressor turn-off temperature is varied. The temperature differential, i.e., the difference in temperature between turn-on and turn-off of the compressor, is therefore also variable. However, the temperature control knob has no substantial effect upon the compressor's predetermined turn-on temperature. Hence, in a constant-on, variable-differential thermostat, the contact-closing temperature, i.e., that which is required to turn the compressor on, always remains the same, while the manual turning of the temperature control knob varies the contact-opening temperature to turn the compressor off.

In order to allow the user to vary the temperature at which the switch contacts will open, i.e., the compressor turn-off temperature, prior refrigeration thermostats, such as that shown in U.S. Pat. No. 3,096,419 to Howell, have utilized what is known as the variable-force technique. In the Howell device, a contact-operating lever is pivotally mounted to open and close the switch contacts when the lever is moved in opposite directions between two fixed-position stops. A snap-action toggle spring is in continuous engagement with the contact-operating lever to bias the lever toward one of the two positions. To selectively adjust the temperature at which the contacts will open, a rotatable cam is connected to the temperature control knob. Rotation of this cam varies the force that is applied to the operating lever by a special biasing spring. This changes the force which must be applied to the operating lever by the temperature-responsive bellows and, consequently, the temperature at which the bellows can apply sufficient force to move the operating lever to its other position to open the switch contacts and turn-off the compressor.

In order to manufacture constant-on thermostats utilizing the variable-force technique, it has been necessary to implement a relatively complex and intricate network of springs, levers, and cams. Such variable-force designs for the temperature control mechanism have a temperature adjustment range which is relatively limited and somewhat imprecise. Moreover, most variable-force thermostats have a limited useful life due to the electrical arcing characteristics of the switch contacts being controlled by the contact-opening mechanism. Furthermore, the complex structure of such thermostats increases the overall cost of the device and decreases its reliability.

A need, therefore, exists for a refrigeration thermostat of simpler construction, having wider temperature range capabilities, better arcing performance, and better reliability.

OBJECTS AND SUMMARY OF THE INVENTION

Accordingly, a primary object of the present invention is to provide an improved constant-on variable-differential type refrigeration thermostat which addresses the problems of the prior known devices.

Another object of the present invention is to provide a refrigeration thermostat which does not utilize the variable-force technique, i.e., does not vary the force applied directly to the operating lever by a user-adjustable temperature control knob.

A further object of the present invention is to provide a refrigeration thermostat having wider temperature range capabilities, better arcing performance, and better reliability than present devices.

These and other objects are achieved by the present invention, which, briefly stated, is a refrigeration thermostat utilizing an alternative "variable-stroke" technique for varying the compressor turn-off temperature, as opposed to the variable-force technique described above. Using the variable-stroke technique, one of the fixed-position stops for limiting the movement of the operating lever is removed, and replaced with a variable-position stop mechanism. The user-accessible temperature control knob is connected to a cam and cam follower assembly to provide the variable-position stop. When the user rotates the control knob to adjust the temperature of the refrigeration appliance, the free end of the cam follower varies the position of the upper-position stop, and hence the stroke, of the operating lever. When the stroke is varied, the force provided by the snap-action toggle spring is changed, and thus the compressor turn-off temperature is adjusted.

According to another aspect of the present invention, an air gap is provided between the actuator prong of the operating lever and the moveable contact blade of the switch contacts, to allow the operating lever to travel downwardly with increased momentum before the switch contacts are opened. With the provision of this air gap, the contact-opening action occurs approximately mid-stroke in the travel of the operating lever. The air gap provides the advantage of a greater impact force, or weld-breaking force, to open the contacts, thereby creating an increased snap-action opening force to improve electrical arcing performance.

More specifically, the present invention provides a temperature controller for a refrigeration appliance having a compressor for providing cooling of the appliance in response to the closing of a set of switch contacts. The temperature controller comprises: a bellows for producing temperature-responsive forces, the bellows connected to a temperature sensor filled with a refrigerant that expands and contracts in response to the change in temperature within the refrigeration appliance, such that a positive force is produced when the temperature within the refrigeration appliance increases to a predetermined compressor turn-on temperature, and such that a negative force is produced when the temperature within the refrigeration appliance decreases to a user-adjustable compressor turn-off temperature; a contact operator for opening the switch contacts in response to a negative force produced by the bellows, the contact operator including a lever arm having a pivot connection at one end such that the other end can move between a first position, wherein the switch contacts are opened, and a second position, wherein the switch contacts are closed, the contact operator including a contact actuator prong affixed to the lever arm, wherein the actuator prong holds the switch contacts opened only when the lever arm is in the first position, and wherein an air gap exists between the actuator prong and the switch contacts such that the actuator prong releases the switch contacts when the lever arm is in the second position; a snap-action toggle spring connected to the contact operator for assisting the movement of the contact operator such that the lever arm normally remains fully engaged in either the first or second positions; a fixed-position stop mechanism for limiting the movement of the lever arm at the first position, the location of the fixed-position stop affecting the turn-on temperature, the location of the fixed-position stop not being readily adjustable by the user of the refrigeration appliance; and a variable-position stop mechanism for limiting the movement of the lever arm at the second position, the location of the variable-position stop mechanism affecting the turn-off temperature, the variable-position stop mechanism including a user-accessible control for adjusting the turn-off temperature.

BRIEF DESCRIPTION OF THE DRAWINGS

The features of the present invention which are believed to be novel are set forth with particularity in the appended claims. The invention itself, however, together with further objects and advantages thereof, may best be understood by reference to the following description, when taken in conjunction with the accompanying drawings, in which:

DETAILED DESCRIPTION OF THE INVENTION

Figure 1:
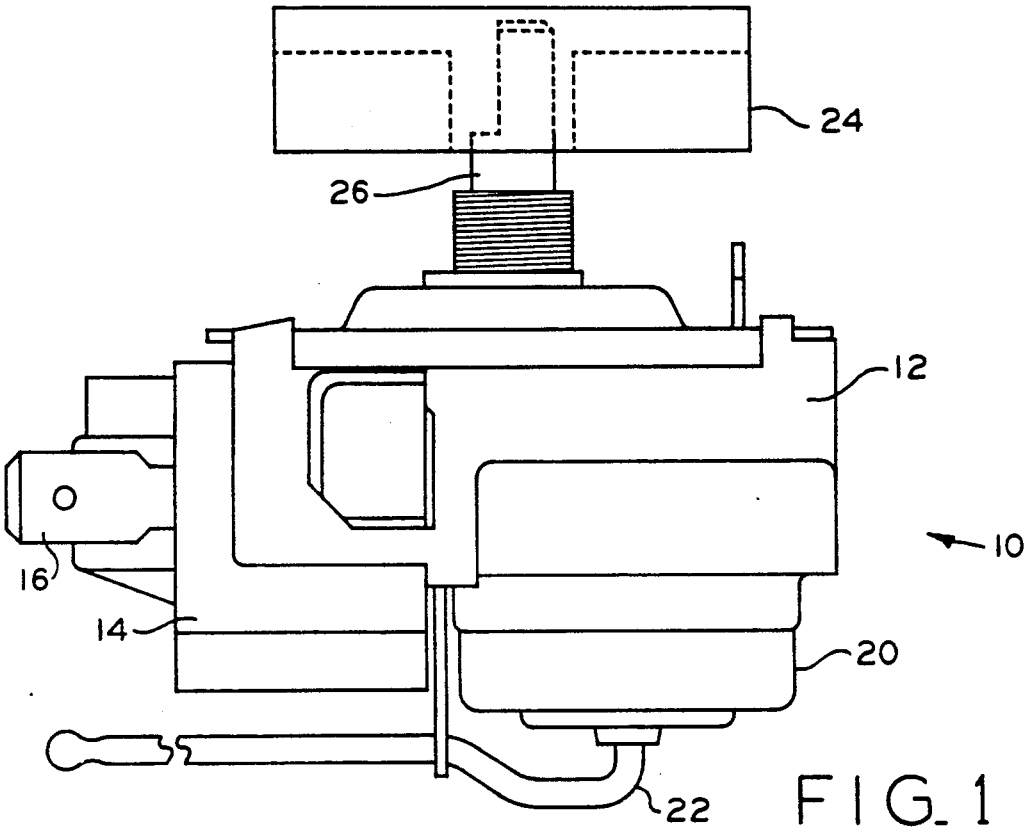
FIG. 1 is a side elevational view of a refrigeration thermostat constructed in accordance with the present invention.
Figure 2:
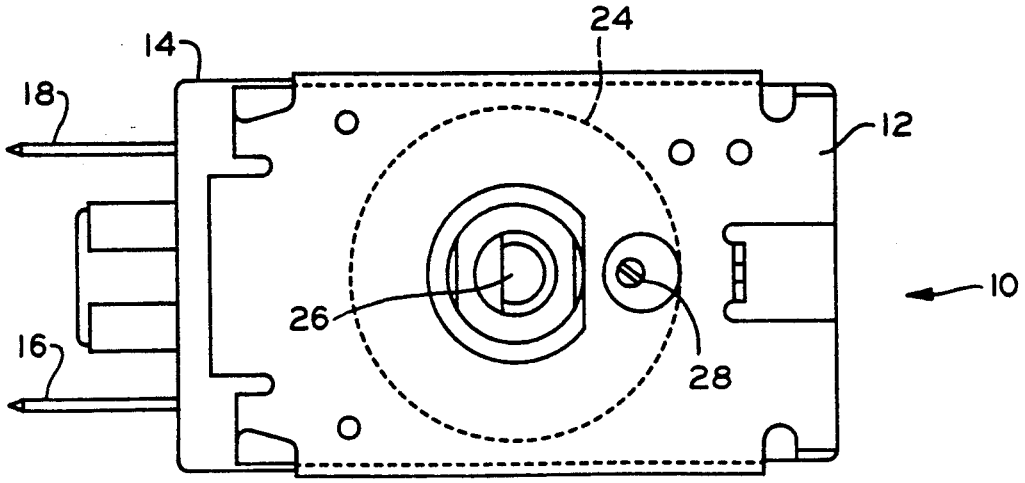
FIG. 2 is a top planar view of the refrigeration thermostat shown in FIG. 1.

Referring now to FIGS. 1 and 2, there is shown a side view and a top view, respectively, of a refrigeration thermostat 10 constructed in accordance with the present invention. This thermostat 10 is generally termed a condition-responsive switching device, and is often used for regulation of the temperature of refrigeration appliances, such as household refrigerators, freezers, air conditioners, etc. The preferred embodiment of the invention is used in an off-cycle defrost refrigerator, wherein the defrosting of the evaporating unit occurs after each cooling cycle. However, this specific application for the refrigeration thermostat of the present invention should be taken as merely illustrative and not limiting.

The thermostat 10 includes a metal frame 12 which is formed of a suitable material such as stainless or plated steel. The frame 12 is securely mounted to a switch housing 14, which, in the preferred embodiment, is formed of molded thermoset or thermoplastic material. The switch housing 14 includes a cavity for mounting the switch contacts, of which only their associated terminals 16, 18 are shown in FIGS. 1 and 2. The frame 12 also supports a bellows 20 which is connected to a condition-sensing capillary tube 22. The bellows 20 serves to communicate pressure differences in the capillary tube 22 based on a physical condition, such as temperature. In accordance with the sensed condition, the refrigeration thermostat 10 will control the electrical connection between the contact terminals 16, 18 as a function of the sensed temperature parameters.

These temperature parameters can be adjusted in various ways. A user-accessible temperature control knob 24, connected to a rotatable shaft 26, is used for adjustment of the compressor turn-off temperature via the manual adjustment of the knob external to the body of the thermostat 10. The knob 24 is shown in phantom in FIG. 2, such that the head of a temperature range calibration screw 28, which is used to set the turn-on temperature, can be seen. Although further details of the switch-operating mechanism will be shown and described below, for additional details of the mechanical construction of the refrigeration thermostat, please refer to the aforementioned General Electric patents which have been incorporated by reference.

Figure 3:
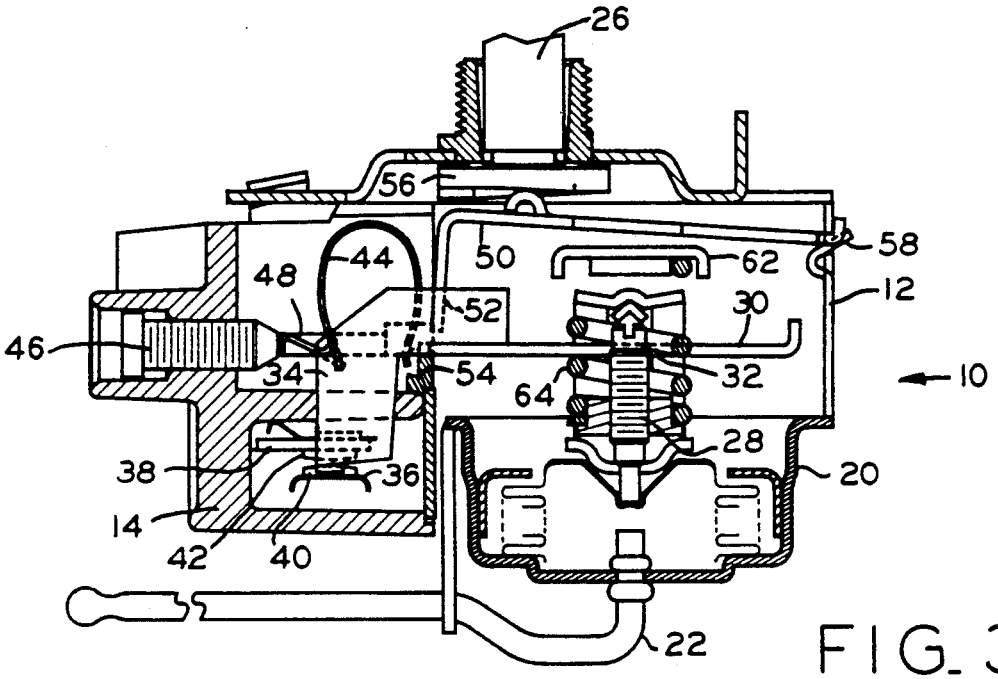
FIG. 3 is a side elevational view, partially in cross-section and partially broken away, of the thermostat shown in FIG. 1.
Figure 4:
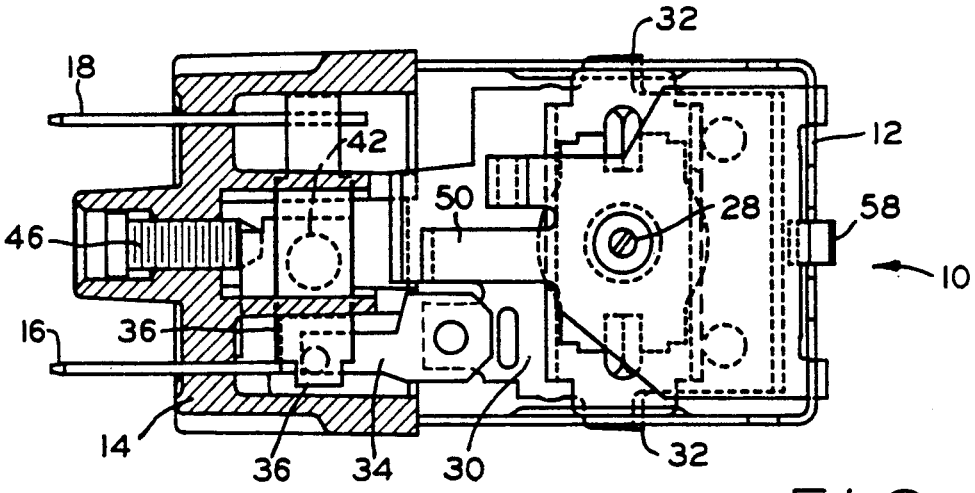
FIG. 4 is a top planar view, partially in cross-section and partially broken away, of the thermostat shown in FIG. 1.

FIGS. 3 and 4 illustrate the internal construction of the refrigeration thermostat 10 according to the present invention. A contact-operating lever 30 is mounted for pivotal movement at a pair of fixed pivot points 32 within the frame 12. The lever 30 moves between a first and second position, both of which will be explained in more detail in the following figures. The operating lever 30 includes an actuator prong 34 secured thereto by a suitable fastener such as a rivet. The actuator prong 34 extends into the cavity of the switch housing 14 in order to separate a lower contact blade 36 from an upper contact blade 38. As shown below in more detail, separating the contact blades 36, 38 serves to open the switch by moving a lower, moveable switch contact 40 away from the upper, stationary switch contact 42, when the operating lever 30 is in its lower position.

At the free end of the operating lever 30, a U-shaped snap-action toggle spring 44 is used to provide the snap-action opening/closing force for the operating lever. The toggle spring 44 is supported by a moveable pivot member 48 which is engaged in channels within the housing 14. The channels allow the pivot member 48 to slide longitudinally within the housing such that its position can be adjusted by a differential temperature adjustment screw 46. By changing the position of the adjustment screw 46, the amount of force which the toggle spring applies to the free end of the operating lever 30 can be adjusted. The effect of the differential temperature adjustment will be explained below in more detail. However, note that the differential temperature adjustment screw 46 is not user accessible, such that the differential temperature calibration point is typically pre-set in the factory at a certain turn-off temperature point.

A cam follower 50 has one end fixedly mounted to the frame 12 for pivotal movement in much the same manner as that of the operating lever 30. The free end of the cam follower 50 is bent downwardly at approximately a 90° angle to the main portion of the cam follower in order to provide a variable-position upper stop 52 to limit the travel of the operating lever 30. A fixed-position lower stop 54 limits the downward travel of the operating lever 30. The lower stop 54 is molded into the plastic housing 14. The position of the cam follower 50, and thus the position of the upper stop 52, varies as the user turns the temperature control knob 24. The knob 24 turns a rotatable cam 56 via the knob shaft 26. A spring 58, positioned against the underside of the cam follower 50 as shown, is used to keep the cam follower 50 in contact with the rotatable cam 56. A fixed spring seat 62, which is secured to the frame 12, provides an upper boundary for a range spring 64 used to counteract the force of the bellows 20. When the cam 56 is rotated, the free end of the cam follower 50 varies the position of the upper stop 52, and hence the stroke, of the operating lever 30. When the stroke is varied, the force on the toggle spring 44 is changed, and the compressor turn-off temperature calibration point can be adjusted by the user. This variable-stroke technique will be explained in more detail in conjunction with FIGS. 5 and 6.

In FIG. 3, the operating lever 30 is shown in its lowermost position, such that the actuator prong 34 is physically touching the lower contact blade 36 to hold the switch contacts 40, 42 in an open position. As will be seen below, the dimensions of the actuator prong 34 are such that an air gap is provided between the actuator prong 34 and the moveable contact blade 36 when the operating lever is in the upper position, to allow the operating lever 30 to travel downwardly with increased momentum before the switch contacts 40, 42 are opened. Through the use of this air gap, the contact-opening action occurs approximately mid-stroke in the travel of the operating lever 30.

Figure 5:
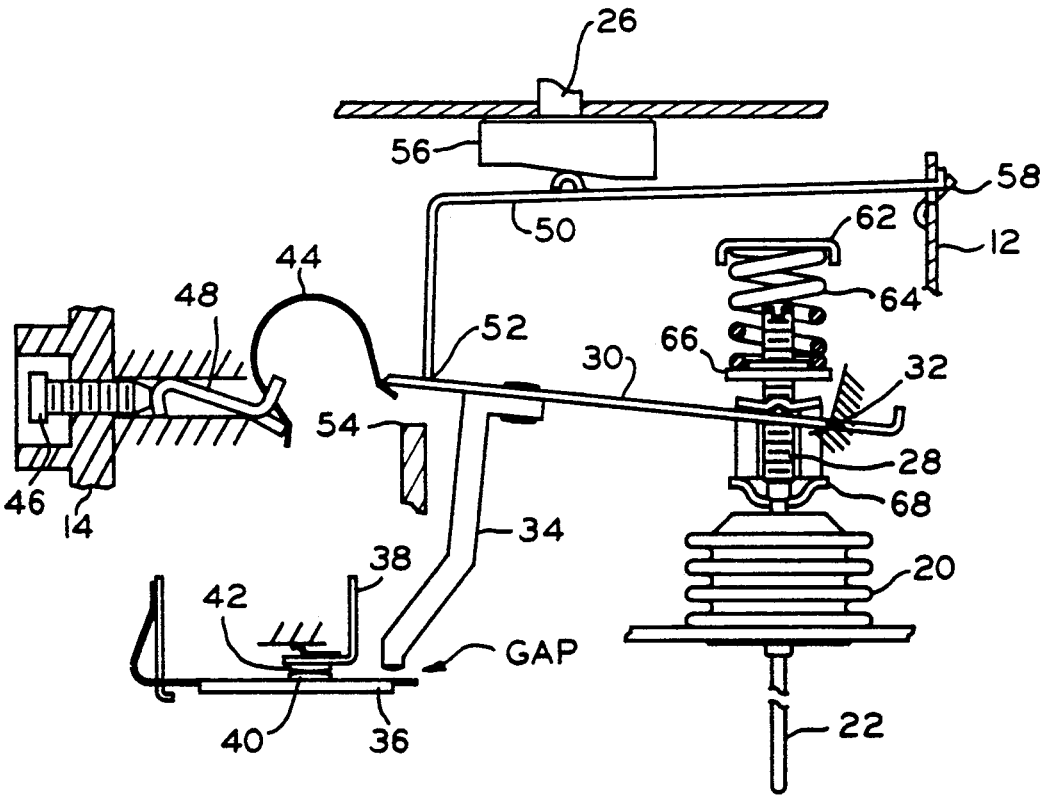
FIG. 5 is a simplified representational side elevation view of the refrigeration thermostat of the present invention showing the contact-operating lever in an upper position.
Figure 6:
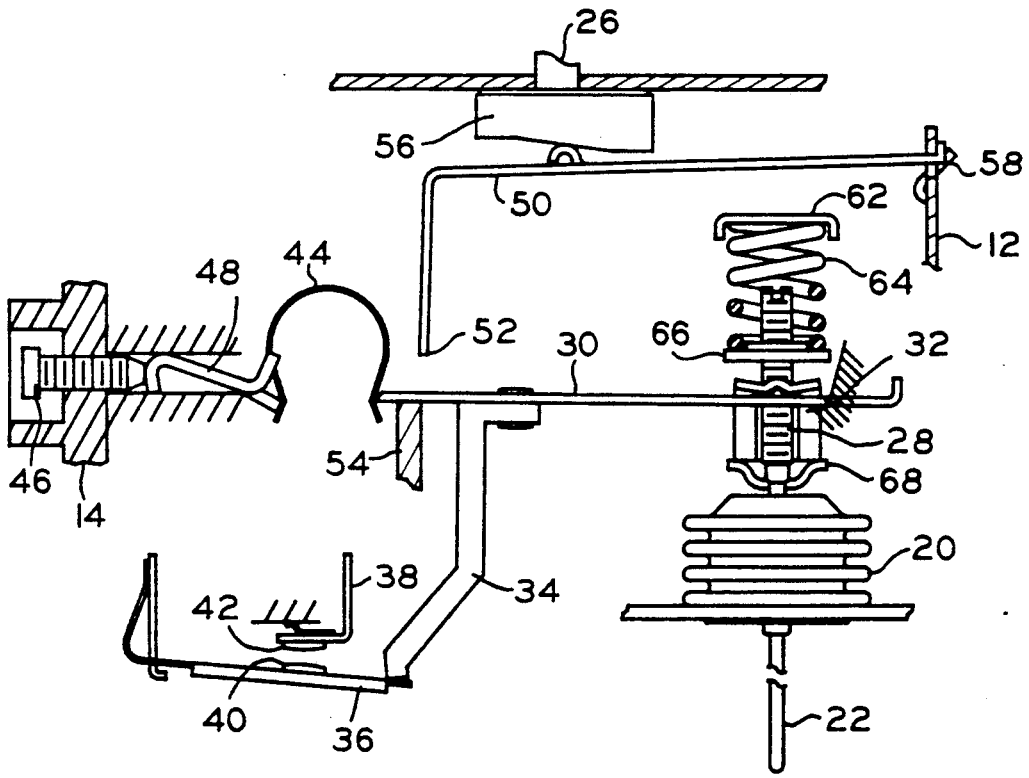
FIG. 6 is a corresponding simplified representational side elevation view to FIG. 5, but showing the contact-operating lever in a lower position.

FIGS. 5 and 6, showing simplified representational side views of the refrigeration thermostat 10, will now be used to describe the operation of the variable-stroke technique as used in the operation of the present invention. As seen in FIG. 5, the operating lever 30 is in its upper position, as defined by the position of the free end or upper stop 52 of the cam follower 50. In the upper position, the switch contacts 40, 42 are maintained closed by the spring force of the lower contact blade 36. From this figure, it can be seen that an air gap exists between the actuator prong 34 and the lower contact blade 36 as shown. The actuator prong has completely released the switch contacts such that the spring force of the lower contact blade 36 holds the contacts closed. Assuming that the thermostat 10 is mounted in a refrigerator, and the capillary tube 22 is positioned to monitor the temperature of the evaporator unit, the closed-contact position shown in FIG. 5 will occur when the refrigerator cabinet is warm, thus requiring the compressor to be turned on. Since the compressor is already turned on, adjusting the position of the cam follower 50 can only affect the compressor turn-off temperature.

When the evaporator unit cools, the pressure inside the bellows 20 decreases, such that the bellows 20 begins to collapse under the force of the range spring 64 applied against a range spring nut 66. A bearing cup 68, secured to the temperature range calibration screw 28, applies a downward force to the operating lever 30. Note that the bellows 20 does not apply an upward force to the operating lever 30, but counters the downward force of the range spring 64. A counterclockwise moment about the operating lever pivot point 32 is produced by the resultant force from the combination of the downward force of the range spring 64 and the upward force of the bellows 20, multiplied by the distance from that point of application at the center of the bearing seat 68 to the pivot point 32. Note that this counterclockwise moment can be adjusted by turning the temperature range calibration screw 28. This calibration screw 28 sets the amount of force provided by the range spring to counteract the force provided by the bellows 20, and thus the sensed temperature at which the bellows activates the operating lever 30. This internal calibration is performed with a screwdriver by a serviceman or factory technician, and is not intended to be externally adjustable by the user. As the pressure inside the bellows 20 continues to decrease with decreasing temperature of the evaporator unit, the counterclockwise moment increases.

A clockwise moment about pivot point 32 is provided by the vertical component of the force produced by the toggle spring 44, multiplied by the distance from the point of application of the force to the pivot point 32. Note that this clockwise moment can be adjusted at the factory by turning the differential temperature adjustment screw 46 which, in turn, adjusts the tension on the toggle spring 44. Just before the operating lever 30 moves to its lower position, the system will reach equilibrium, i.e., when the clockwise moment about pivot point 32 provided by the toggle spring 44 is equal to the counterclockwise moment about pivot point 32 provided by the resultant force of the range spring 64 and the bellows 20.

Further reduction of the evaporator unit temperature, and the corresponding reduction in the bellows force, causes the counterclockwise moment to exceed the clockwise moment, such that the operating lever 30 moves away from the free end of the cam follower 50 by an infinitesimally small amount. When this occurs, the vertical component of the force produced by the toggle spring 44 begins to diminish and further unbalance the moments about the pivot point 32. In this way, the toggle spring causes a snap-action to force the operating lever 30 away from the variable-position stop 52 to the fixed-position stop 54.

Approximately mid-stroke in the downward travel of the operating lever 30, the actuator prong 34 strikes the lower contact blade 36, thus opening the contacts 40, 42, and turning the compressor off. Hence, it can be seen that varying the position of the cam follower 50 by rotating the cam 56 varies the stroke of the operating lever 30. When the stroke is varied, the vertical component of the toggle spring force is changed, such that a different force is required to be produced by the bellows 20 to change the moments about the pivot point 32. Moreover, when the operating lever moves, the actuator prong 34 travels through the air gap at an increased velocity to provide a high-impact force on the contact blade 36, thus assisting in breaking the contact welds caused by electrical arcing.

In FIG. 6, the contacts 40, 42 are shown in an open position, wherein the compressor would be turned off. With the compressor off, the temperature in the refrigerator cabinet is allowed to increase. As the temperature increases, the bellows 20 expands and produces a greater upward force against the range spring 64. The pressure in the bellows 20 increases until the moments about the pivot point 32 again reach equilibrium. A very slight increase in temperature beyond the compressor turn-on temperature produces a clockwise moment which is larger than the counterclockwise moment, such that the operating lever 30 quickly moves from the fixed-position lower stop 54 to the variable-position upper stop 52 allowing the contacts to close. This completes one temperature cycle. Note that since the range spring 64 is not connected to the cam follower 50 when the operating lever 30 is in the lower position shown in FIG. 6, any adjustment of the knob shaft 26 and the cam 56 does not affect the compressor turn-on temperature. The location of the fixed-position stop 54 would affect the turn-on temperature if it were moveable. However, only the upper-position stop 52 is moveable, and the thermostat is calibrated such that the turn-on temperature is approximately 36° F. Hence, the invention operates as a constant-on thermostat.

Figure 7:
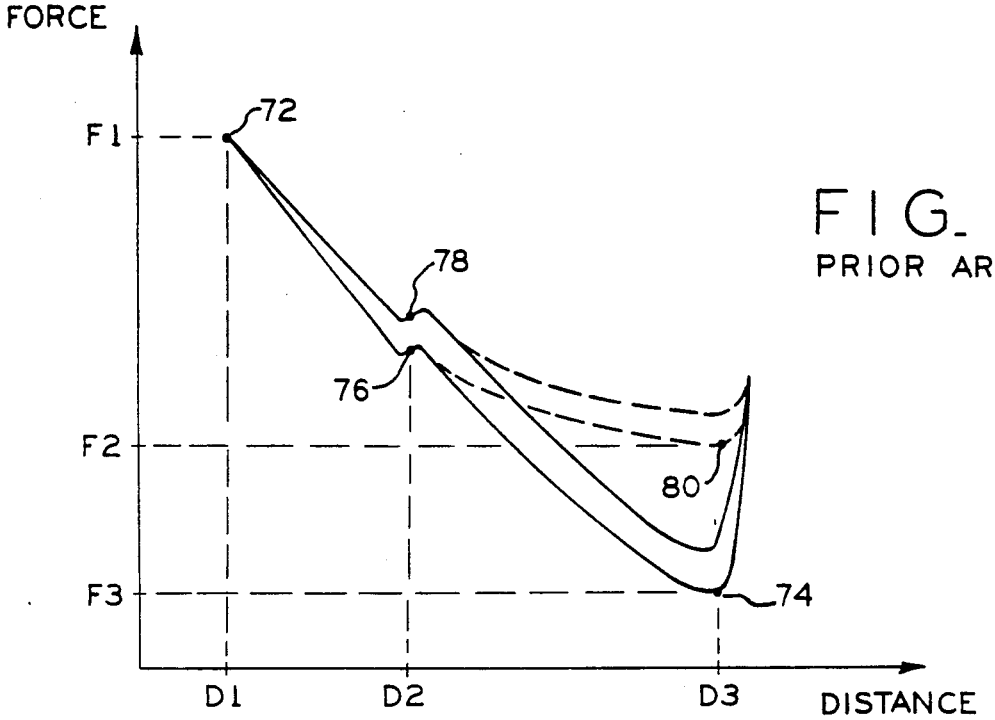
FIG. 7 PRIOR ART
FIG. 7 is a representational graph of the force versus stroke operating. characteristics of the refrigeration thermostat of the prior art, illustrating the variable-force technique.
Figure 8:
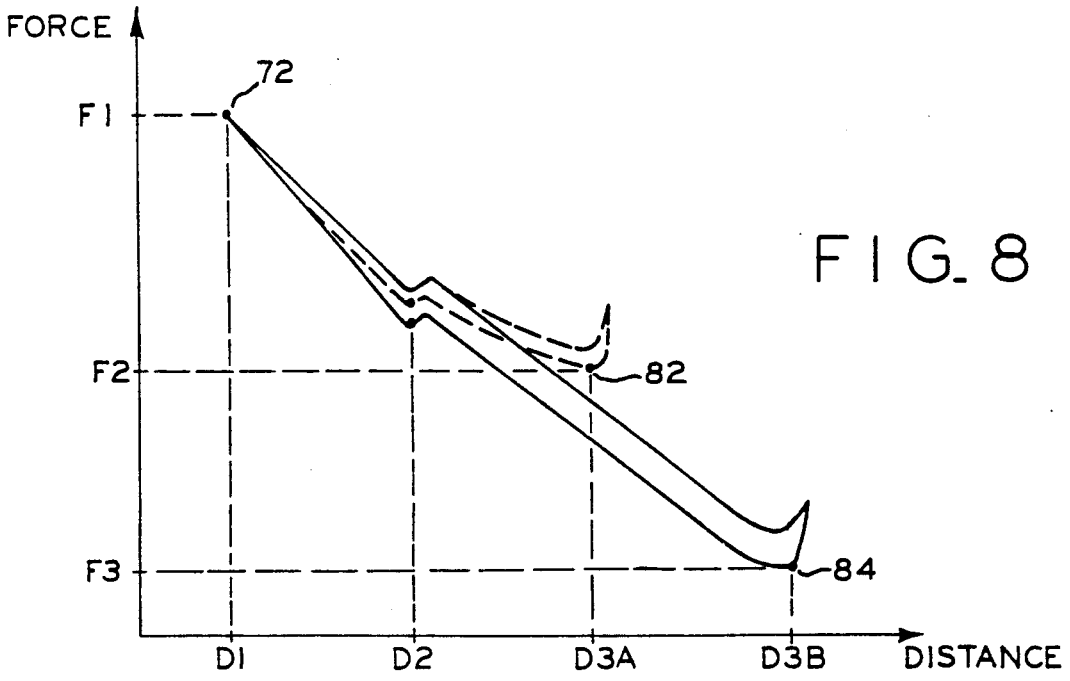
FIG. 8 is a corresponding representational graph of the force versus stroke operating characteristics of the refrigeration thermostat of the present invention, illustrating the variable-stroke technique.

FIGS. 7 and 8 are graphic representations of the amount of upwardly-directed force applied to the contact-operating lever 30 (vertical axis) versus distance of travel of the operating lever (horizontal axis). Note that the vertical axis also generally corresponds to the change in temperature of the evaporator unit, since the bellows transforms the temperature change into a force change. The contact-operating lever 30 moves with a snap-action between a lower position D1 and an upper position D3 in a cyclical manner as shown in the graphs. After the temperature rises above the compressor turn-on temperature, a sufficient force F1 is applied to the operating lever 30 to move it to its upper position, the location of which is represented by D3 on the graph. After the temperature drops, a force F3 is applied to cause the operating lever 30 to move to its lower position, represented by D1.

FIG. 7 illustrates the operation of the variable-force technique as known in the art, wherein both the lower-position stop at D1 and the upper-position stop at D3 are fixed to the housing, and wherein the knob shaft 26 directly adjusts the amount of force applied to the range spring 64 (see, e.g., U.S. Pat. No. 4,937,549 to Kelly et al.) or a special biasing spring directly applies additional force to the operating lever (see, e.g., U.S. Pat. No. 3,096,419 to Howell). The uppermost point 72 on the graph of FIG. 7 represents the amount of force F1 required to toggle the operating arm from the lower position D1 to the upper position D3 to close the switch contacts and turn the compressor on. This action occurs after the temperature has risen to the turn-on temperature. In a typical application, this turn-on temperature would correspond to approximately 36° F. Again, note that the compressor turn-on temperature is constant for a constant-on thermostat, i.e., it is not adjustable by the user.

When the temperature decreases, the combined upward force on the operating lever 30 decreases until a force F3 is eventually reached at point 74. At this point, the operating lever 30 moves from the upper position D3 to return to the lower position D1, thereby opening the switch contacts and turning the compressor off. The contacts are actually opened at a point 76, corresponding to a distance D2 which is intermediate the distance D1 and D3. With the compressor off, the temperature again increases, and the upward forces increase until F1 is reached at point 72 where the snap-action of the operating lever 30 moves it to the compressor turn-on position D3 at point 74. The contacts are actually closed at a point 78, again corresponding to D2. Note that the minor split between points 76 and 78 are due to friction losses in the system as the forces are applied to the operating lever in different directions. However, this minor difference in forces has no effect on the turn-on or turn-off temperatures.

In a variable-force system, the maximum travel of the operating lever 30 is defined by the distance between the two fixed-position stops. Therefore, as can be seen from the graph of FIG. 7, the stroke of the operating lever, defined by the distance D1–D3, is constant. However, the compressor turn-off temperature would vary with the amount of force applied to the operating lever 30. By increasing the amount of downward force directly applied to the operating lever, an increased upward force must be supplied by the bellows to move the operating lever to the upper position. As shown in FIG. 7, the operating arm will snap to the upper position at point 80 when an increased force F2 is applied to the operating lever. Therefore, an increased turn-off temperature would result. Varying the force on the operating arm between F2 and F3 varies the turn-off temperature between a maximum at point 80 and a minimum at point 74. A variable-force thermostat may have, for example, a maximum turn-off temperature of approximately 16° F., and a minimum turn-off temperature of approximately −20° F., for a temperature calibration range of approximately 36° F. assuming 18 p.s.i. maximum differential and R12 refrigerant.

Finally, FIG. 8 presents a graphical representation of the force versus distance characteristics for the variable-stroke technique used in the present invention. Although the turn-on temperature calibration force F1 at point 72 remains constant, the turn-off temperature is varied by changing the length of the stroke of the operating lever from D3A to D3B. Position D3A corresponds to the maximum compressor turnoff temperature calibration point 82, which would occur when the cam 56 is rotated such that the cam follower variable-position stop 52 is in its lowermost position closest to the fixed-position stop 54. On the other hand, when the cam 56 is rotated such that the variable-position stop 52 is in its uppermost position D3B, the minimum turn-off temperature calibration point 84 must be reached before the compressor is turned off. The distance D3A-D3B represents the variable-stroke portion of the movement of the operating lever, which is externally adjustable by the user to determine the compressor turn-off temperature calibration point. Again, note that the actual closing of the contacts occurs at the distance D2 which is approximately half-way between position D1 and D3A. In the preferred embodiment, the maximum turn-off temperature is approximately 30° F., and the minimum turn-off temperature is approximately −20° F., such that the temperature calibration range is approximately 50° F assuming 25 p.s.i. maximum differential and R12 refrigerant. In the preferred embodiment, the range of travel of the operating lever is approximately between 0.030 and 0.060 inches. Therefore, referring to the graph of FIG. 8, the minimum stroke D1-D3A is approximately 0.030 inches, while the maximum stroke D1-D3B is approximately 0.060 inches.

In review, it can now be seen that the present invention provides a constant-on variable-stroke refrigeration thermostat wherein the toggle spring-biased operating lever has a fixed-position stop when the contacts are open and a variable-position stop when the contacts are closed, and wherein the operating lever provides an increased force to quickly open the switch contacts by traveling through the aforementioned air gap. The primary advantage provided by the present invention is that the thermostat is of a much simpler construction, which results in a lower cost and a higher reliability. The preferred embodiment contains at least nine fewer parts than that which has previously been required to manufacture a comparable thermostat using the variable-force technique. Furthermore, as can be seen from the graph of FIG. 8, the present invention has an increased temperature calibration range from that generally available using the variable-force technique. The use of the air gap between the actuator prong of the operating lever and the moveable contact blade of the switch contacts provides a greater impact force, or weld-breaking force, to open the contacts, thereby creating an increased snap-action opening force to improve electrical arcing performance.

While only particular embodiments of the invention have been shown and described herein, it will be obvious that further modifications and improvements may be made by those skilled in the art. Accordingly, the appended claims are intended to cover all such modifications and alternative constructions that fall within the true scope and spirit of the invention.

What is claimed is:

1. A temperature controller for a refrigeration appliance including a compressor for providing cooling of the appliance in response to the closing of a set of switch contacts, the compressor having a turn-off temperature being adjustable by a user of the refrigeration appliance, said temperature controller comprising:

a bellows assembly for producing temperature-responsive forces, said bellows assembly connected to a temperature sensor filled with a refrigerant that expands and contracts in response to a change in temperature within the refrigeration appliance such that a positive force is produced when the temperature within the refrigeration appliance increases to a predetermined compressor turn-on temperature and such that a negative force is produced when the temperature within the refrigeration appliance decreases to a user-adjustable compressor turn-off temperature;

a contact operator for opening said switch contacts in response to a negative force produced by said bellows assembly, said contact operator including a movable lever arm having two ends and a pivot connection at one end such that the other end can move between a first position, wherein said switch contacts are opened, and a second position, wherein said switch contacts are closed, said contact operator including a contact actuator prong affixed to said lever arm, wherein said actuator prong holds said switch contacts opened only when said lever arm is in said first position, and wherein an air gap exists between said actuator prong and said switch contacts such that said actuator prong releases said switch contacts when said lever arm is in said second position;

a toggle spring connected to said contact operator for assisting the movement of said lever arm such that said lever arm normally remains fully engaged in either said first or second positions;

a fixed-position stop mechanism for limiting the movement of said lever arm at said first position, said fixed-position stop mechanism having a location affecting said turn-on temperature, the location of said fixed-position stop mechanism not being readily adjustable by the user of the refrigeration appliance; and a variable-position stop mechanism for limiting the movement of said lever arm at said second position, said variable-position stop mechanism having a location affecting said turn-off temperature, said variable-position stop mechanism including a user-accessible control for adjusting said turn-off temperature.

2. The temperature controller according to claim 1, wherein said temperature controller includes a main body, and wherein said user-accessible control includes a shaft which extends at least partially external to said main body such that said shaft is readily adjustable by the user.

3. The temperature controller according to claim 2, wherein the turn-off temperature can be decreased by the user by rotating said shaft such that the distance between said fixed-position stop mechanism and said variable-position stop mechanism is increased.

4. The temperature controller according to claim 2, wherein the turn-off temperature can be increased by the user by rotating said shaft such that the distance between said fixed-position stop mechanism and said variable-position stop mechanism is decreased.

5. The temperature controller according to claim 2, wherein rotating said shaft does not directly affect the force applied to the contact operator by the bellows assembly.

6. The temperature controller according to claim 2, wherein said variable-position stop mechanism includes a rotatable cam attached to said shaft.

7. The temperature controller according to claim 6, wherein said variable-position stop mechanism further includes an L-shaped cam follower having two ends and a pivot connection at one end such that the other end defines the position of said lever arm at said second position.

8. The temperature controller according to claim 2, wherein said variable-position stop mechanism includes a knob which is accessible to the user for adjusting the position of said variable-position stop mechanism.

9. The temperature controller according to claim 1, wherein only the turn-off temperature of said temperature controller is readily adjustable by the user of the refrigeration appliance.

10. The temperature controller according to claim 1, wherein said toggle spring is connected to said other end of said lever arm, said toggle spring being generally omega-shaped.

11. The temperature controller according to claim 1, wherein the distance between said first and second lever arm positions varies in response to the adjustment of said user-accessible control.

12. The temperature controller according to claim 1, wherein said temperature controller is a constant-on refrigeration thermostat for an off-cycle defrost refrigeration appliance.

13. The temperature controller according to claim 1, wherein the function of said air gap between said actuator prong and said switch contacts is to increase the impact force upon opening the switch contacts.

14. The temperature controller according to claim 1, wherein said fixed-position stop mechanism is constructed as an integral part of said housing.

15. The temperature controller according to claim 1, wherein said predetermined compressor turn-on temperature is preset to be within the temperature range of 33° F. to 40° F.

16. The temperature controller according to claim 1, wherein said user-adjustable compressor turn-off temperature is adjustable by the user over a range of at least 40° F.

* * * * *